US010472854B2

(12) United States Patent
Haake et al.

(10) Patent No.: US 10,472,854 B2
(45) Date of Patent: Nov. 12, 2019

(54) LOCKING SYSTEM HAVING CONTACT SURFACES

(71) Applicants: André Haake, Stadtlohn (DE); Oliver Haake, Stadtlohn (DE); Patrick Haake, Vreden (DE)

(72) Inventors: André Haake, Stadtlohn (DE); Oliver Haake, Stadtlohn (DE); Patrick Haake, Vreden (DE)

( * ) Notice: Subject to any disclaimer, the term of this patent is extended or adjusted under 35 U.S.C. 154(b) by 239 days.

(21) Appl. No.: 15/257,943

(22) Filed: Sep. 7, 2016

(65) Prior Publication Data

US 2016/0376813 A1 Dec. 29, 2016

Related U.S. Application Data

(63) Continuation of application No. PCT/EP2015/054830, filed on Mar. 9, 2015.

(30) Foreign Application Priority Data

Mar. 7, 2014 (DE) ..... 10 2014 103 070

(51) Int. Cl.
*E05B 17/00* (2006.01)
*E05B 19/00* (2006.01)

(52) U.S. Cl.
CPC ..... *E05B 17/0004* (2013.01); *E05B 19/00* (2013.01)

(58) Field of Classification Search
CPC ..... E05B 17/0004; E05B 19/00
See application file for complete search history.

(56) References Cited

U.S. PATENT DOCUMENTS 5,383,740 A * 1/1995 Lancelot, III ..... E04C 5/165 403/267
2006/0090528 A1* 5/2006 Moening ..... E05B 19/04 70/395
2013/0152352 A1 6/2013 Haake et al.
2013/0186872 A1* 7/2013 Bruckner ..... B23K 31/02 219/127

FOREIGN PATENT DOCUMENTS

FR 2877974 A1 5/2006

OTHER PUBLICATIONS

Machine Translation of FR2877974.*

* cited by examiner

*Primary Examiner* — Moshe Wilensky
*Assistant Examiner* — Kyle A Cook
(74) *Attorney, Agent, or Firm* — Jeffrey Joyce, Esq.

(57) ABSTRACT

A method for creating a key and a female lock part for a lock, whereby just a few parts are used to create a high number of unique locks. A coding part and a blank are affixed to each other to create the key or female lock part. Coding part and blank each have a contact surface, which, when brought together, can rotate continuously relative each other. The coding part is placed on the blank at a desired rotational position and affixed in that position, either by welding or adhesively. To create a lock with a unique lock function, two coding parts with mating contact surfaces are each attached to a blank, The key and female lock part so made function only with each other. In this way, the same basic coding part and basic blank can be used to create a large number of different locks.

11 Claims, 2 Drawing Sheets

LOCKING SYSTEM HAVING CONTACT SURFACES

BACKGROUND INFORMATION

Field of the Invention

The invention relates to a lock system with contact surfaces. More particularly, the invention relates to a method of coding a key and a female lock part of a lock of a locking system.

Discussion of Prior Art

French publication FR 2 877 974 A1 discloses a conventional method of coding parts of a lock system. The key and female lock part are each manufactured with the help of a blank and a separate component, namely, a specific coding part is provided to each part. The coding parts of the key and female lock part complement each other, so that the key is able to actuate the female lock part of the lock.

The surfaces of both components that make contact with each other, i.e., the coding part and the blank, are referred to as contact surfaces, and these interacting contact surfaces are constructed geometrically on the coding part and also on the blank, such, that they enable a plurality of different rotational positions, so that the same coding part may be selectively placed on the blank.

The coding parts may also be produced in small production runs and, because they may be affixed in different rotational positions to the blank, they always result in differently embodied keys or female lock parts, because the locking system is constructed such, that the key can only be guided into the female lock part in a pre-determined alignment. Thus, two keys can have identical coding parts, but they are assembled on their specific blanks at different angular positions. As a result, only one of these two keys can fit the corresponding female lock part, whereas the second key does not represent a functional key for this female lock part.

BRIEF SUMMARY OF THE INVENTION

It is an object of the present invention to improve a conventional method of coding a key and a female lock part of a lock in a locking system to simplify the production of the two parts and to achieve an additional economic advantage by enabling the use of identically constructed coding parts to produce a large number of locks, each lock so produced being differently coded, such that the key and corresponding female lock part for each lock is a unique paired lock set. It is a further object of the invention to provide such a lock in which key and female lock part, using the least number of different parts, can be configured to the greatest number of differently coded paired lock sets.

With the method according to the invention the interacting contact surfaces between a coding part and a blank are not coded in a way that results in the parts only able to be attached to each other in a few pre-determined rotational positions. Rather, blank and coding part are relatively continuously rotatable relative each other, so that they can be arranged in almost limitless rotational positions. If no stop is provided to limit this rotational movement, then the two parts are freely rotatable a full 360 degrees relative each other. If, on the other hand, a stop is provided to limit this rotational movement, then numerous different continuous rotational positions are possible within the available range of angular rotation. In any case, the method according to the invention enables the creation of differently coded keys or female lock parts that have very close gradations of different rotational positions between the coded part and the blank, without requiring a highly precise fine-mechanical constructions of the contact surfaces along with the corresponding closely scanned contouring.

The simplest and, thus, most economic embodiment as far as production is concerned, is to provide smooth contact surfaces. It is also possible, that one contact surface be contoured and the opposite contact surface be smooth, so that, in this embodiment, the coding part may be rotated in any direction relative the blank, as long as there is no hindrance to the rotation of the two parts, which would limit the possible angular positions of the two parts to each other. It is also possible, that the contact surfaces of both parts be contoured, as long as these contours do not result in a limitation of rotational movability relative each other. Thus, for example, rays of radial ridges may be provided on one contact surface and circular concentric ridges be provided on the other contact surface. These two different contour geometries do not mesh with each other, i.e., the contact surface of the coding part cannot mesh with the contact surface of the blank. Consequently, the contours do not limit the rotational movability between these two parts. These contours do, however, increase the surface area of the respective contact surface and may therefore be advantageous for other reasons, which are explained below.

The conventional method of manufacturing a key or a female lock part is to thread the coding part onto the blank so that the parts are aligned along a common center line. The contour of the contact surfaces prevents deviating rotational positions there, when the coding part is first fastened to the blank, for example by means of the threaded fastening.

With the method according to the invention, however, the respective rotational position of the coding part relative the blank is not mechanically fixed. The coding part must, however, be attached to the blank in the selected rotational position and in a way, that the connection between the two parts is torque-proof and resistant to tensile forces, i.e., secured against forces that act to rotate the two parts relative each other or pull them apart. As an example of such a connection, after the coding part and the blank are arranged in their desired rotational position, two parallel threaded bores may be generated in the axial direction to allow a threaded fastener to screw the coding part to the blank, thereby creating a connection that is resistant to torque and tensile forces. In another example, the two parts may overlap in the axial direction, so that they can be pinned or screwed together by means of a radial bore that runs through both parts.

It is more advantageous, however, if the coding part is not fastened to the blank by means of such costly subsequent processing. In order to ensure a reliable fastening of the coding part to the blank, one that is resistant to torque and tensile forces, these coding part and blank may be adhesively affixed to each other, welded together, or bound together with a grout compound, instead of a mechanical fastening of the two parts. With the adhesive means, the adhesive may be placed between the two contact surfaces. The contours mentioned above increase the surface area of the contact surfaces and thereby improve the transmission of force from one part to the adhesive. The grout compound, after hardening, provides a positive form-fit connection between the coding part and the blank, even when these two parts do not make a positive form-fit contact with each other. The contours on the two parts as described above cannot provide a direct positive form-fit connection between the two parts, but do function to provide a positive form-fit connection with the cured and hardened grout compound.

The method according to the invention makes it possible to produce great numbers of different functional female lock parts and keys, using the same coding part and the same blank. The number of unique lock sets that can be produced with the same two parts depends on the production precision of the lock. If, for example, it is possible to very precisely guide the key as it approaches the female lock part, then the coding part of the key no longer fits to the coding part of the female lock part, when there is a rotational deviation of just one degree of the key to the female lock part. Hence, using the same parts, 360 differently constructed keys and female lock parts may be produced, whereby the offset in the rotational angle between coding part and blank in each case is just 1 degree. Significantly fewer different variations of the key or female lock part are achievable, if a mechanical coding between the coding part and the blank is used. Thus, the method according to the invention provides a significantly more cost-effect production of the key or female lock part, due to the substantially greater possible uses of the same parts.

Advantageously, the coding part may be attached to the blank only at its outer circumference to the blank. Coding part and blank, thus, are brought together initially in the desired rotational position and held against each other. Affixing the coding part to the blank may then be done in a very simple manner on the outside. For example, both parts together may form an outer circumferential groove, i.e., the edges of the groove are formed by these two parts, and then an adhesive, for example, may be placed in the groove, thereby adhesively affixing the two parts to each other. The adhesive is not applied to the surfaces between the two components, but rather, only to the outer edges. This is advantageous to achieve a particularly precise alignment of the coding part to the blank, because the coding part is not floating on an adhesive film on which it could possibly shift in an undesired manner before the adhesive has hardened. If, however, the two parts are already affixed to each other, then, adhesive may be added to the contact surfaces of the coding part and the blank, in addition to the outer circumference. This achieves the largest possible surface area for adhesion and makes for a mechanically highly loadable fastening of the coding part to the blank.

The coding part and blank may be welded together. This type of connection may also be limited to the outer circumference of the two parts, because welding makes a mechanically high loadable fastening of the coding part to the blank, even if it is only along the circumference. Welding also makes it possible to construct the two parts as simply and economically as possible, for example, as solid blocks or discs or dowels. With these constructions, the contact surfaces, when placed against each other, are only accessible from the outside. This is particularly the case, if both of these contact surfaces are constructed as smooth surfaces, so that there are no intermediate spaces between the two parts.

Laser welding is a very suitable method of welding the coding part to the blank. The diameter of the laser beams is very small diameter and may be very precisely directed. Thus, if one or both of the contact surfaces are contoured, then the precision of laser welding allows areas of the contact surfaces that are some distance in from the outer circumference to be welded. In this case, attachment points between the coding part and the blank may be created, not only on the outer circumference, but also further in toward the center of the contact surfaces. If, however, in an economic embodiment, the coding part and the blank each have a smooth contact surface and a seam is present only circumferentially around the outer circumference, then laser welding makes it possible to obtain a very precise weld seam. The two parts are hardly heated beyond the areas adjacent the weld seam. Thus, undesired deformations of the contact surfaces are reliably prevented, thereby ensuring that the precise alignment of the contact surfaces, which is essential for the proper functioning of the two coding parts on the key and on the female lock part, is maintained. Also, thermal loading due to welding may be kept particularly low by using spot-welding to create multiple individual attachment spot welds.

The blank and the coding part may be connected to one another by means a single type of attachment means. It is, however, also possible to combine two or more attachment means, for example, to adhesively affix the two parts to each other as well as to weld a seam or one or more spot-welds. The adhesive attachment seals off any gap between the two parts and the welding serves to reduce the mechanical loading on the adhesive attachment. Or, when a mechanical attachment means is used, for example, threaded fasteners or pinning, an adhesive or welded attachment may be provided as an additional means.

A centering aid may be provided as a means to correctly position the coding part on the blank and to simplify implementation of the method according to the invention. Such a centering aid may be constructed in the form of a circumferential collar that is provided on one of the parts, i.e., either on the coding part or on the blank, and that fits circumferentially over the other part. This reliably prevents the part encased by the collar from shifting in a radial direction, thus ensuring that the corresponding part is centered.

BRIEF DESCRIPTION OF THE DRAWINGS

The present invention is described with reference to the accompanying drawings. In the drawings, like reference numbers indicate identical or functionally similar elements.

DETAILED DESCRIPTION OF THE INVENTION

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

Figure 1:
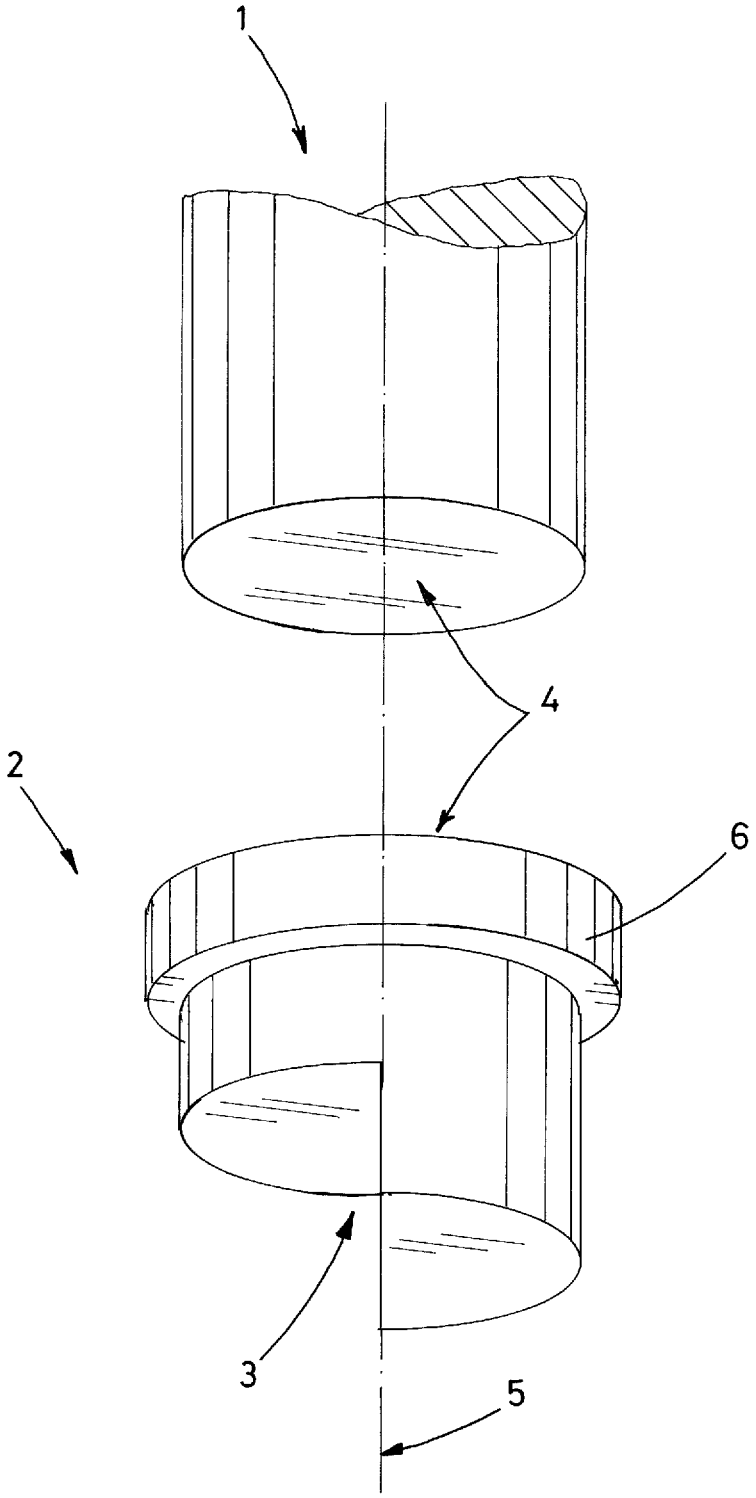
FIG. 1 is a perspective view of a first embodiment of a coding part and blank according to the invention, with the blank shown only partially and the coding part shown some distance away from the blank.

FIG. 1 illustrates a blank 1 and a coding part 2 to be used in a lock that has a female lock part and requires a key to operate the lock. The two parts are shown aligned around a common centerline 5. The blank 1 in this embodiment is shown only partially and has the form of a cylindrical pin, although this is only an example. The blank 1 may be used to create either of the two lock components, i.e., the key or the female lock part. The coding part 2 is to be attached to the blank 1 to create the particular lock component. The coding part 2 has a free end that faces away from the blank 1 and is a coding surface 3. In this embodiment, the coding surface 3 has a stepped contour that is created by a Z-shaped separation cut. This separation cut creates a complementary second coding part 2, so that one of the coding parts 2 is attached to the blank 1 to form the key and the other attached to another blank 1 to form the female lock part.

Both the coding part 2 and the blank 1 have a contact surface 4. These two contact surfaces 4 are brought in contact with each other when the coding part 2 is attached to the blank 2 to produce either the key or the female lock part. In the embodiment shown, both contact surfaces 4 are smooth surfaces, so that complete surface contact is possible between these two contact surfaces 4. Due to their smooth surfaces, the contact surfaces 4 that are placed against each other make it possible to rotate the coding part 2 to any degree about the centerline 5. This ability to rotate to any degree means that the coding part 2 may be placed in any rotational position on the blank 1.

The coding part 2 has a circumferential collar 6 with an inner diameter that corresponds to the outer diameter of the blank 1. The collar 6 serves as a centering aid to ensure that the two parts are properly aligned with each other.

After the two parts have been placed against each other, i.e., the contact surfaces 4 of the blank 1 and the coding part 2 are in contact with each other and the coding part 2 is placed at the desired rotational position on the blank 2, the joint at the edge of the collar 6 and the adjacent circumferential surface of the blank 1 is laser welded to affix the two parts to each other in the desired position.

The collar 6 encircles the entire circumference of the coding part 2, so that the weld seam that is created forms a tight, closed connection of the coding part 2 to the blank 1 around the entire circumference of the joint and also prevents the egress of moisture or contaminants into the area between the two contact surfaces 4. The weld seam thus maximizes the stability of the attachment between the coding part 2 and the blank 1.

Figure 2:
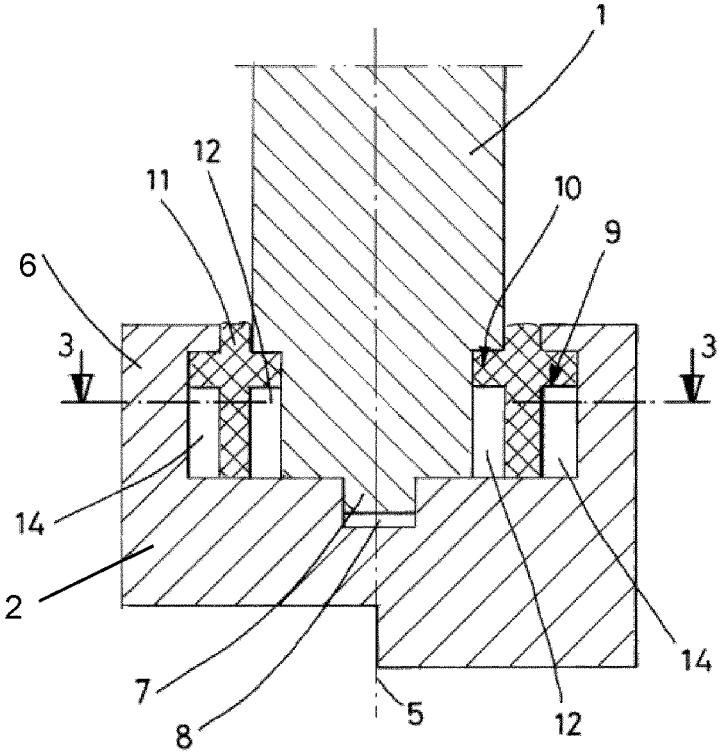
FIG. 2 is a longitudinal cross-section through a second embodiment, with the coding part attached to the blank.

FIG. 2 shows a second embodiment of the coding part 2 and the blank 1 according to the invention. The collar 6 in this embodiment, by which the coding part 2 overlaps the blank 1 a certain distance, is constructed to fit flush against the outside of the coding part 2 and to remain a distance from the blank 1, i.e., has no guiding or centering function. A centering aid in the form of a circular protrusion 7 and a mating bore 8 is provided, to ensure a precise alignment of the coding part 2 with the blank 1. The protrusion 7 is provided on the contact surface 4 of the blank 1 and the circular bore 8 on the contact surface 4 of the coding part 2. The circular bore 8 guides the pin 7 in a radial direction, but allows any rotational positioning of these two parts relative each other.

The inner surface of its collar 6, i.e., the surface facing the blank 1, has a first circumferential groove 9 and the blank 1 has an outer second circumferential groove 10 in the area that is inside the collar 6 when the two parts are brought together. The circumferential grooves 9 and 10 represent only as an example contours that create protrusions or undercuts in the direction of the center axis 5.

A grout compound 11 is filled into the gap between the blank 1 and the coding part 2 and also fills in the circumferential grooves 9 and 10. After the grout compound 11 hardens, the coding part 2 and the blank 1 are connected to each in a way that prevents them from pulling apart, i.e., they cannot be pulled apart in the axial direction of the center axis 5. Although the coding part 2 and the blank 1 do not have a positive form fit with each other that would connect them so that they cannot be pulled apart, the grout compound indirectly creates such a positive form-fit, even it does not connect non-positively to the coding part 2 or the blank 1 as an adhesive. The grout compound 11 thus preferably has high mechanical stability with regard to tensile and shear forces. Suitable compounds include, for example, plastics or a materials that are commercially available as a cold metal, liquid metal, or metal in a tube.

Figure 3:
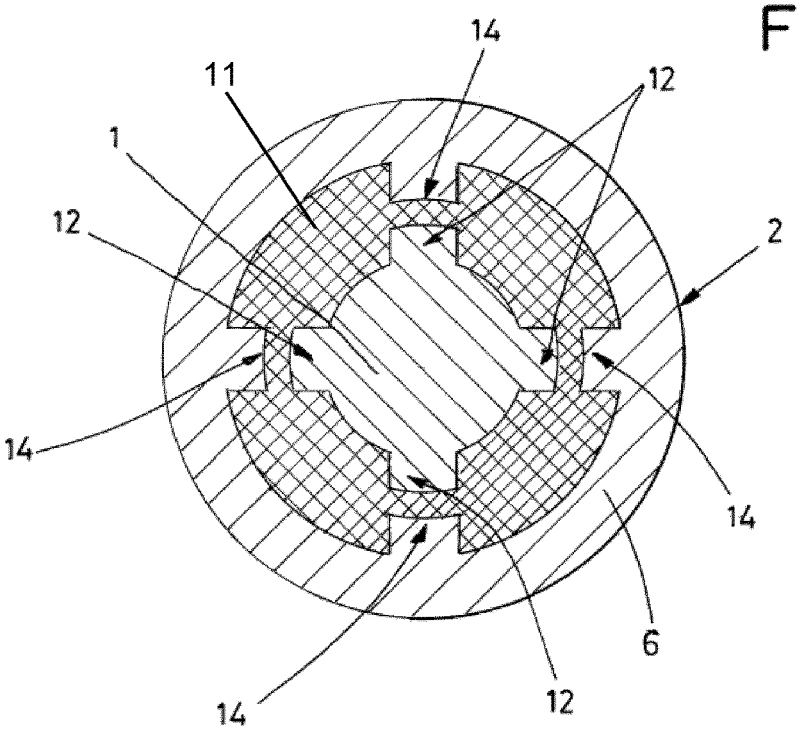
FIG. 3 is a cross-section through the second embodiment along the line 3-3 in FIG. 2.

FIG. 2 shows a contour in the axial direction, namely, a contour formed by the circumferential grooves 9 and 10. FIG. 3, on the other hand, shows a contour of the blank 1 and the coding part 2 in the rotational direction, namely, first protrusions 12 on the blank 1 and second protrusions 14 on the coding part 2, whereby the protrusions 12 and 14 extend in the axial direction. After the grout compound 11 hardens, the blank 1 and the coding part 2 are connected to each other with a positive form-fit that prevents rotational movement, whereby the coding part 2 and the blank 1 do not have a direct form-fit contact with each other, but rather, this positive form-fit is indirectly created between the two parts, i.e., by the hardened grout compound 11 that forms a positive form-fit with both the coding part 2 and the blank 1.

It is understood that the embodiments described herein are merely illustrative of the present invention. Variations in the productions methods or the embodiments of the blank and the coding part may be contemplated by one skilled in the art without limiting the intended scope of the invention herein disclosed and as defined by the following claims.

What is claimed is:

1. A method for coding a lock part for a lock in a locking system, the lock part being a key or a female lock part, the method comprising the steps of:

(a) providing a blank;

(b) creating a coding part that has a coding surface configured to interlock with a complementary shaped surface on the other one of the key or the female lock part;

(c) providing a contact surface on the coding part and a contact surface on the blank, wherein the two contact surfaces allow rotational movement relative each other after they are brought into contact with one another;

(d) selecting a desired rotational position of the contact surface of the coding part against the contact surface of the blank, wherein the desired rotational position may be any rotational position between zero degrees and three-hundred and sixty degrees; and rotating the coding part and the blank relative to one another until the coding part and the blank are positioned in the desired rotational position; and (e) affixing the coding part to the blank while the respective contact surfaces of the coding part and the blank are in contact with one another, while maintaining the desired rotational position, the affixing being such that the coding part and blank cannot subsequently be pulled apart or rotated relative each other; and (f) machining the blank such that the machined blank is configured to actuate the female lock part or be actuated by the key.

2. The method of claim 1, wherein the step of affixing the coding part to the blank includes a welding process.

3. The method of claim 2, wherein the welding process is a spot-welding process.

4. The method of claim 1, wherein the step of affixing the coding part to the blank includes applying an adhesive.

5. The method of claim 1, wherein the step of affixing the coding part to the blank includes filling a grout compound in between the coding part and the blank and allowing the grout compound to harden.

6. The method of claim 1, wherein the coding part has an outer circumference and is attached to the blank only at the outer circumference.

7. The method of claim 1, further comprising the step of:

(g) providing a centering aid prior to affixing the coding part to the blank, wherein the centering aid places the coding part and the blank in proper alignment to each other.

8. The method of claim 7, wherein the centering aid is provided on the contact surface of the coding part.

9. The method of claim 7, wherein the centering aid is constructed as a collar that is provided on the coding part and that fits over a portion of the blank, so as to center the blank relative the coding part.

10. The method of claim 7, wherein the centering aid is provided on the contact surface of the blank.

11. The method of claim 7, wherein the centering aid is constructed as a collar that is provided on the blank and that fits over a portion of the coding part, so as to center the coding part relative the blank.

* * * * *